US007217147B2

(12) United States Patent
Yoshida et al.

(10) Patent No.: US 7,217,147 B2
(45) Date of Patent: May 15, 2007

(54) POWER SOURCE OUTLET DEVICE

(75) Inventors: Atsushi Yoshida, Aichi (JP); Koji Mizuno, Aichi (JP)

(73) Assignee: Kawamura Electric, Inc., Aichi (JP)

( * ) Notice: Subject to any disclaimer, the term of this patent is extended or adjusted under 35 U.S.C. 154(b) by 0 days.

(21) Appl. No.: 11/192,399

(22) Filed: Jul. 29, 2005

(65) Prior Publication Data

US 2006/0030183 A1 Feb. 9, 2006

(30) Foreign Application Priority Data

Jul. 30, 2004 (JP) ..... 2004-224598
Jul. 30, 2004 (JP) ..... 2004-224599
Jul. 30, 2004 (JP) ..... 2004-224600
Jul. 30, 2004 (JP) ..... 2004-224601

(51) Int. Cl.
*H01R 13/53* (2006.01)

(52) U.S. Cl. ..... 439/181

(58) Field of Classification Search ..... 439/181, 439/182, 620.08, 608, 180
See application file for complete search history.

(56) References Cited

U.S. PATENT DOCUMENTS 5,342,208 A * 8/1994 Kobayashi et al. ..... 439/79
5,342,220 A * 8/1994 Kodama ..... 439/607
6,659,783 B2 * 12/2003 Copper et al. ..... 439/181
6,799,983 B2 * 10/2004 Pavlovic et al. ..... 439/181
6,955,551 B2 * 10/2005 Yamamoto ..... 439/181
2004/0253859 A1 * 12/2004 Hirata et al. ..... 439/181

FOREIGN PATENT DOCUMENTS

JP 2001-035599 A 2/2001
JP 2004-327247 A 11/2004

* cited by examiner

*Primary Examiner*—Phuong Dinh
(74) *Attorney, Agent, or Firm*—Arent Fox LLP

(57) ABSTRACT

A sensor can be mounted easily and an insulating distance between the sensor and a receiving blade can beheld reliably. A through-hole 7 is formed between plug insertion holes 6, 6, and a sensor 16 which detects a spark discharge occurring between plug blades is disposed internally of the through-hole 7. An insulating partition wall 13 is disposed between receiving blades 17, 17 in a standing manner, the sensor 16 is accommodated inside the partition wall, and arrangement is performed such that a portion of the sensor faces the through-hole. An outlet case is formed with an intermediate base body 5 provided with a mounting portion of the receiving blade 17 and a partition wall 13, a main body 3 which holds a circuit board 22 and the intermediate base body 5, and a cover body 4 which covers a front face of the main body 3.

19 Claims, 14 Drawing Sheets

(a)

(b)

(a)

(b)

(a)

(b)

POWER SOURCE OUTLET DEVICE

TECHNICAL FIELD

The present invention relates to a power source outlet device which detects a spark discharge occurring before tracking occurrence to prevent occurrence of tracking.

BACKGROUND ART

Conventionally, there is a device shown in Patent Literature 1 as a power source outlet device having a function of preventing tracking. In a technique of Patent Literature 1, an electrically conductive plate is disposed in plug insertion holes on a front face of a power source outlet device, one end thereof being protruded from a surface while another end thereof being connected to a ground terminal, so that a leakage current occurring between plug blades is led to flow to the ground terminal via the electrically conductive plate before tracking occurs and a cable run is disconnected by letting a leakage breaker detect the leaked current.

However, in the above-described conventional power source outlet device, since an electrically conductive plate serving as a sensor is exposed to a surface of a cover of the power source outlet device, malfunction may occur when an electrically conductive material comes in contact with the electrically conductive plate. Further, a user's hand or the like may touch the sensor, and such exposure is not desirable.

In view of these circumstances, the present applicant has proposed a power source outlet device where a through-hole is provided without exposing a sensor to a surface of a cover of the power source outlet device so that a spark discharge (scintillation) between plug blades which causes a tracking phenomenon can be detected inside the cover in Patent Literature 2. In the power source outlet device, such a method is adopted that a sensor is disposed on a back face of the cover as a sensor mounting structure, and the sensor is fixed being covered its back portion with insulator such as resin.

[Patent Literature] JP-A-2001-35599

[Patent Literature] JP-A-2004-327247

DISCLOSURE OF THE INVENTION

[Problem to be Solved by the Invention]

However, in a constitution of the above-described Patent Literature 2, since fine manipulation must be conducted in a small space, there is such a drawback that workability deteriorates. Further, since connection between the sensor and the circuit board is made through a lead wire, it is necessary to perform soldering, which results in troublesome work.

Further, for preventing water or dusts from entering in the through-hole and reducing an output current from the sensor to reduce a load on an amplifying circuit, the smaller the through-hole is, the more excellent it is. In the power source outlet device of Patent Literature 2, however, a diameter limit of the through-hole is approximate 0.5 mm due to property of moldability of a cover produced from insulating material such as synthetic resin. Therefore, there is such a problem that moldability and productivity deteriorates when the through-hole is downsized.

In order to solve the above problem, an object of the present invention is to provide a power source outlet device to which a sensor can be mounted easily and which implements an excellent discharge detecting behavior without downsizing of a through-hole to a limit.

[Means for Solving the Problem]

In order to solve the above problem, the invention described in claim 1 is a power source outlet device which is provided on a front face of an outlet case formed from insulating material with at least one pair of plug insertion holes, and receiving blades paired which pinch plug blades of a plug being disposed inside the plug insertion holes, and the power source outlet device having a through-hole between the plug insertion holes on the front face of the outlet case, and a sensor which detects a spark discharge occurring between the plug blades being disposed internally of the through-hole, characterized in that a partition wall made from insulator is disposed between the receiving blades in a standing manner, the sensor is received in the partition wall, and the sensor is disposed such that a portion thereof faces in the through-hole.

With the constitution, the sensor can be mounted without adhesion operation so that mounting can be conducted easily.

The invention of claim 2 is characterized in that the outlet case comprises an intermediate base body which has a receiving blade mounting portion and the partition wall and which holds the sensor, a main body which holds a circuit board and the intermediate base body, and a cover body which covers a front face of the main body and has the plug insertion holes in the invention described in claim 1. With the constitution, assembling workability can be improved.

The invention of claim 3 is characterized in that the sensor is received in the partition wall by insertion molding in the invention described in claim 1. With the constitution, a mounting work of the sensor can be eliminated.

The invention of claim 4 is characterized in that the sensor is received in the partition wall by insertion molding in the invention described in claim 2. With the constitution, a mounting work of the sensor can be eliminated.

The invention of claim 5 is characterized in that a sensor insertion hole is formed in the partition wall and the sensor is fittingly inserted in the sensor insertion hole to be received therein in the invention described in claim 1. With the constitution, the sensor can be mounted by the fitting-insertion, so that mounting of the sensor can be performed easily.

The invention of claim 6 is characterized in that a sensor insertion hole is formed in the partition wall and the sensor is fittingly inserted in the sensor insertion hole to be received therein in the invention described in claim 2. With the constitution, the sensor can be mounted by the fitting-insertion, so that mounting of the sensor can be performed easily.

The invention of claim 7 is characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board in the invention described in claim 2. With the constitution, connection between the sensor and the circuit board can be performed easily.

The invention of claim 8 is characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board in the invention described in claim 3. With the constitution, connection between the sensor and the circuit board can be performed easily.

The invention of claim 9 is characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board in the invention described in claim 4. With the constitution, connection between the sensor and the circuit board can be performed easily.

The invention of claim 10 is characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board in the invention described in claim 5. With the constitution, connection between the sensor and the circuit board can be performed easily.

The invention of claim 11 is characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board in the invention described in claim 6. With the constitution, connection between the sensor and the circuit board can be performed easily.

The invention of claim 12 is characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other in the invention described in claim 2. With the constitution, connection between the sensor and the circuit board can be performed easily.

The invention of claim 13 is characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other in the invention described in claim 3. With the constitution, connection between the sensor and the circuit board can be performed easily.

The invention of claim 14 is characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other in the invention described in claim 4. With the constitution, connection between the sensor and the circuit board can be performed easily.

The invention of claim 15 is characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other in the invention described in claim 5. With the constitution, connection between the sensor and the circuit board can be performed easily.

The invention of claim 16 is characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other in the invention described in claim 6. With the constitution, connection between the sensor and the circuit board can be performed easily.

The invention of claim 17 is a power source outlet device which is provided on a front face of an outlet case formed from insulating material with at least one pair of plug insertion holes, and receiving blades paired which pinch plug blades of a plug being disposed inside the plug insertion holes, and the power source outlet device having a through-hole between the plug insertion holes on the front face of the outlet case, and a sensor which detects a spark discharge occurring between the plug blades being disposed internally of the through-hole, characterized in that a bushing with elasticity made from insulating material is pressure-fitted into the through-hole and the bushing has at least one through-hole extending in a pressure-fitting direction, and a surface of the outlet case and the sensor are caused to communicate with each other through the at least one through-hole so that the sensor can detect a spark discharge.

With the constitution, since it is unnecessary to form the through-hole down to the limit in a small size, moldability of the outlet case is excellent and productivity is improved. Further, a hole diameter of a detection hole can be made small and since the bushing has the elasticity, cleaning of the detection hole is easy. Furthermore, when many detection holes are formed in the bushing, it is possible to expand a detection range for a spark discharge.

The invention of claim 18 is a power source outlet device which is provided on a front face of an outlet case formed from insulating material with at least one pair of plug insertion holes, and receiving blades paired which pinch plug blades of a plug being disposed inside the plug insertion holes, and the power source outlet device having a through-hole between the plug insertion holes on the front face of the outlet case, and a sensor which detects a spark discharge occurring between the plug blades being disposed internally of the through-hole, characterized in that a bushing with elasticity made from insulator is pressure-fitted into the through-hole and a gap is provided at at least one portion of a contacting face between the bushing and the through-hole, a surface of the outlet case and the sensor are caused to communicate with each other through the gap so that the sensor can detect a spark discharge.

With the constitution, since it is unnecessary to downsize the through-hole to the limit, moldability of the outlet case is excellent and productivity is improved. Further, a gap for detecting a spark discharge can be made small, and since the bushing has elasticity, cleaning to the gap is facilitated.

The invention of claim 19 is a power source outlet device which is provided on a front face of an outlet case formed from insulating material with at least one pair of plug insertion holes, and receiving blades paired which pinch plug blades of a plug being disposed inside the plug insertion holes, and the power source device having a through-hole between the plug insertion holes on the front face of the outlet case, and a sensor which detects a spark discharge occurring between the plug blades being disposed internally of the through-hole, characterized in that a bushing made of an insulating permeable body is embedded in the through-hole.

With the constitution, since it is unnecessary to downsize the through-hole to the limit, moldability of the outlet case is excellent and productivity is improved. Further, a detection range for a spark discharge can be expanded since detection is conducted on the surface of an area, and even if the surface is wiped, clogging does not occur, so that cleaning is easy.

[Effect of the Invention]

Thus, according to the inventions of claims 1 to 16, mounting of a sensor for detecting a spark discharge and connection between the sensor and a circuit board are easy and assembling easiness is improved. Further, according to the inventions of claims 17 to 19, since it is unnecessary to downsize a through-hole to a limit, moldability of an outlet case is excellent and productivity is improved.

BEST MODE FOR CARRYING OUT THE INVENTION

Embodiments of the present invention will be explained below in detail with reference to the drawings.

First Embodiment

Figure 1:
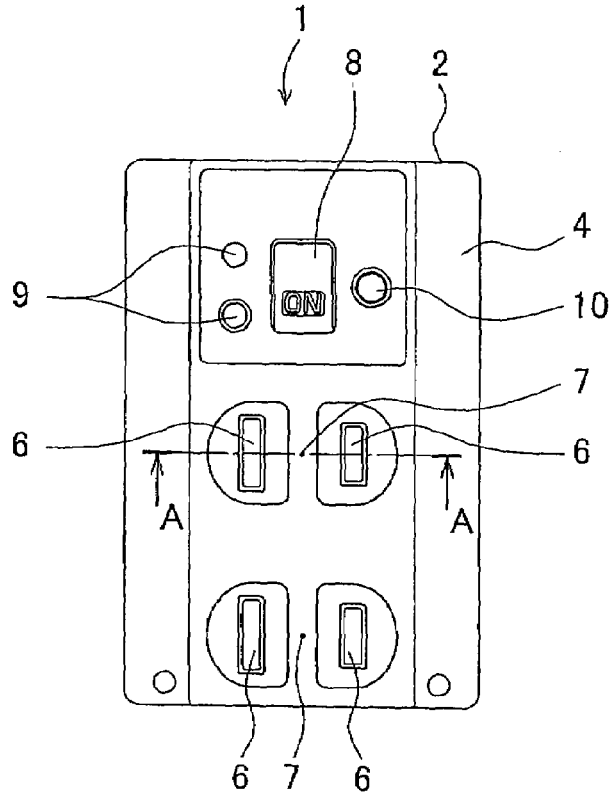
FIG. 1 is a front view of a power source outlet device showing a first embodiment of the present invention.
Figure 2:
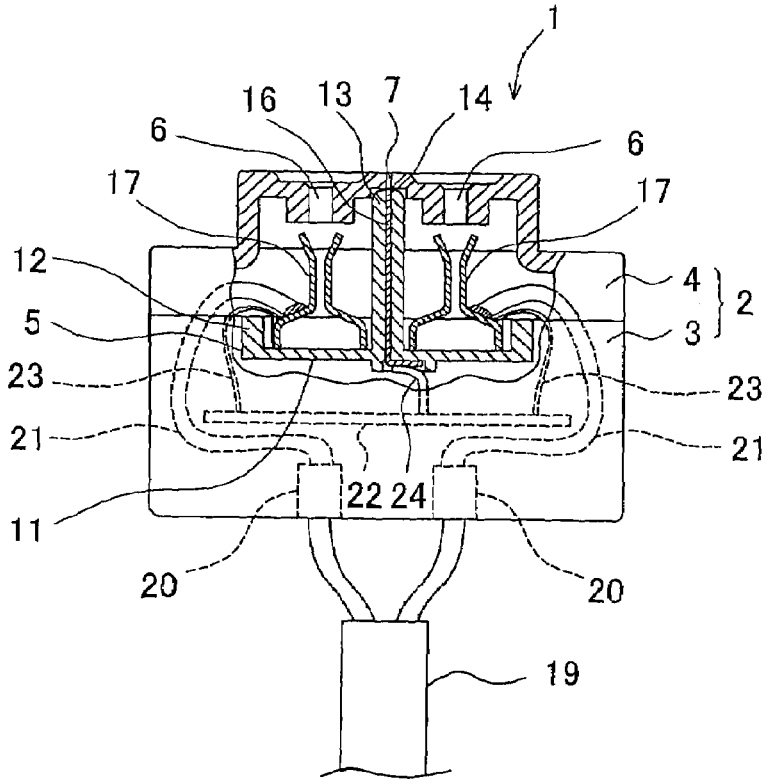
FIG. 2 is a sectional view of the power source outlet device taken along line A—A in FIG. 1.

FIG. 1 is a front view showing a first embodiment of a power source outlet device according to the present invention and FIG. 2 is a sectional view of the power source outlet device taken along line A—A. An outlet case 2 of a power source outlet device 1 is constituted of a main body 3 with a front face opened, a cover body 4 mounted so as to close the front face opening of the main body 3, and an intermediate base body 5 accommodated in an inner space formed by the main body 3 and the cover body 4. The outlet case 2 is formed from insulating material such as synthetic resin, and it is assembled internally with a leakage current detecting circuit, a breaker for breaking a cable run, and the like.

The cover body 4 is formed on its front face with a pair of plug insertion holes 6, 6 for inserting plug blades (not shown) of a plug at each of two positions of a central portion and a lower portion, and a through-hole 7 is formed at an intermediate position between plug insertion holes of each pair. The cover body 4 is provided on its upper portion with an operation handle 8 for performing return operation of the breaker which has performed breaking behavior at a tracking time, display lamps 9 which display leakage occurrence, tracking occurrence and the like, and a test button 10 which tests leakage breaking behavior.

Figure 3:
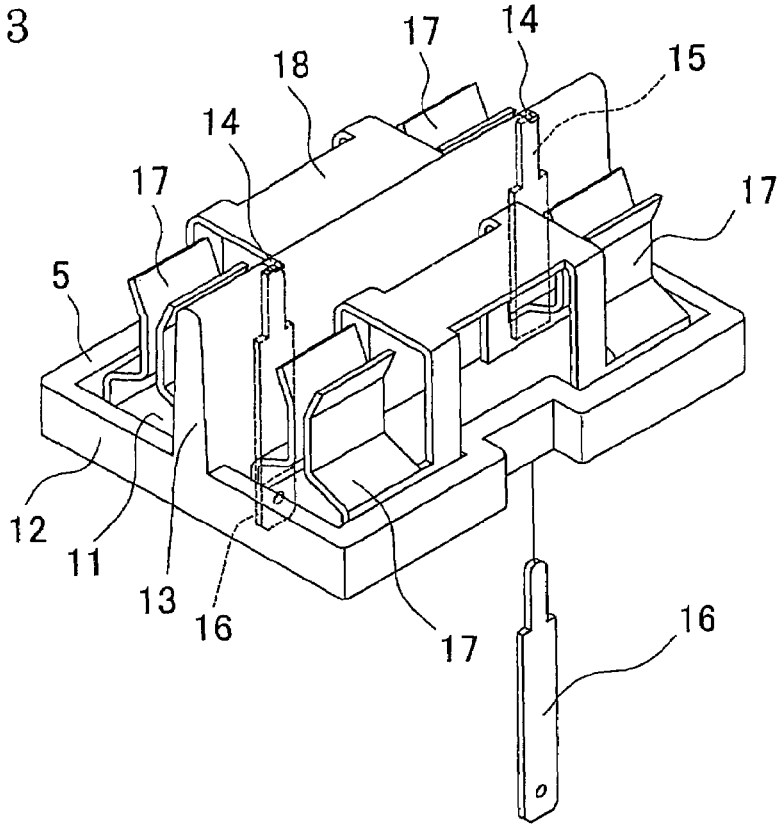
FIG. 3 is a perspective view showing an intermediate base body shown in FIG. 1.

The intermediate base body 5 is formed such as shown with a perspective view in FIG. 3. It is formed with a standing portion 12 over an entire periphery of a rectangular plate portion 11 and a partition wall 13 extending to a back face of the cover body 4 at an intermediate position in a shorter size direction thereof. Holes 14 are formed on a front end of the partition wall 13 at positions opposed to the through-holes 7 of the cover body 4, and sensor insertion holes 15 continuous to the holes 14 are formed at a rear end of the partition wall 13. A sensor 16 made of a metal plate is fittingly inserted into the sensor insertion hole 15, and the sensor 16 is mounted such that its front end faces the hole 14. The sensor 16 is provided such that its rear end is exposed from a back face of the intermediate base body 5. Thus, such arrangement is performed that one portion of the sensor 16 faces the through-hole 7 via the hole 14, so that a spark discharge occurring between the plug blades of the plug can be detected.

Further, receiving blades 17 pinching plug blades of a plug are positioned and disposed on both left and right sides regarding the partition wall 13 by the standing portion 12 and the partition wall 13. Since upper and lower receiving blades 17 have the same polarity, they are coupled by a coupling portion 18. The receiving blade 17 is connected with a wire 21 connected to an insertion terminal 20 of the main body 3 connected with a cable 19 extending from a cabinet panel or the like, and a wire 23 for a power source whose one end is connected to a circuit board 23 described later.

Incidentally, when the sensor 16 is insert-molded to the partition wall 13, the time-consuming work for mounting can be avoided. It should be noted that the sensor 16 may be formed from an electrically conductive member instead of the metal plate.

On the other hand, the circuit board 22 mounted with various circuits, such as a tracking detecting circuit and a power source circuit, is accommodated in a space behind the intermediate base body 5 in parallel with the rectangular plate portion 11 of the intermediate base 5. The circuit board 22 is connected with one end of the lead wire 24 whose other end is connected to the sensor 16, and it is electrically connected with the tracking detecting circuit and the sensor 16. Further, a breaker (not shown) is accommodated in a space above the intermediate base body 5.

The power source outlet device 1 with the above constitution performs a tracking detecting behavior in the following manner. When dusts are accumulated between the plug blades of the plug connected to the receiving blades 17, 17 and the dusts absorb air moisture, a minute current flows between the plug blades via the moisture. When moisture thus charged with the minute current evaporates, a spark discharge occurs. Then, when the spark discharge which has occurred enters through the through-hole 7 and contacts with the sensor 16, a minute current flows in the sensor 16. The tracking detecting circuit detects tracking (correctly speaking, detects occurrence of a spark discharge causing tracking) from an output current of the sensor 16 to cause the breaker to behave and perform displaying with the display lamp 9.

Thus, a spark discharge occurring before tracking occurrence is detected and outlet output is stopped. The sensor can be mounted by simple insertion to the partition wall of the intermediate base body, so that mounting of the sensor can be implemented easily. An insulating distance between the sensor and the receiving blade can be secured reliably.

Figure 4:
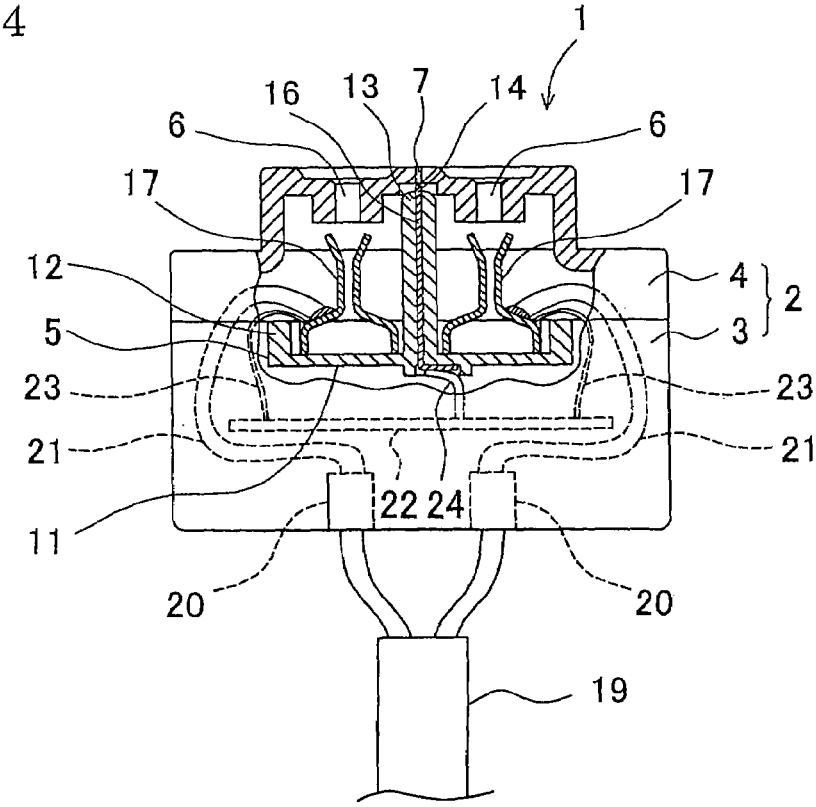
FIG. 4 is a sectional view of a main portion of a power source outlet device showing a modification of a constitution of a sensor mounting portion.

Incidentally, in the embodiment, although formation is made such that a distal end of the sensor does not project from the partition wall 13, formation can be performed such that the distal end of the sensor 16 projects from the partition wall 13, as shown with a sectional view in FIG. 4.

Figure 5:
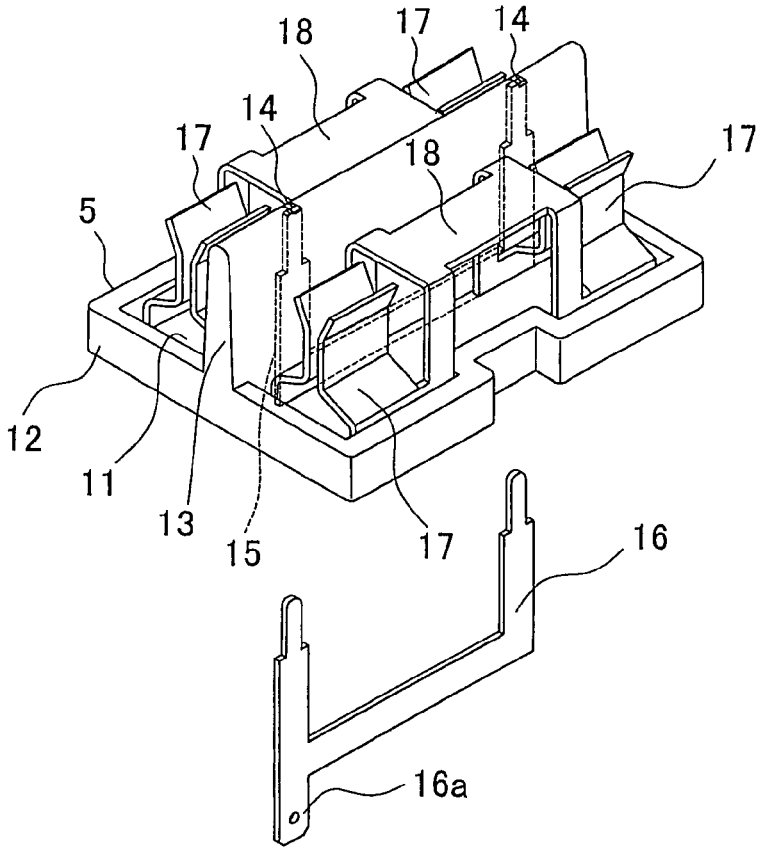
FIG. 5 shows a perspective view of an intermediate base body shown in FIG. 1 and shows a modification of a sensor.
Figure 6:
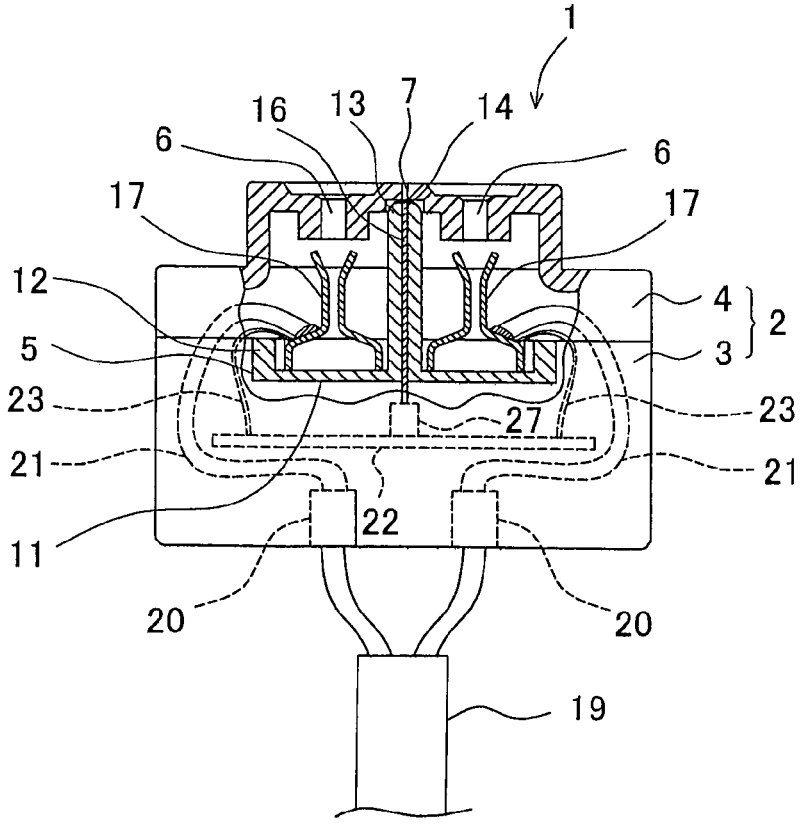
FIG. 6 is a sectional view of a main portion of a power source outlet device showing a mounting structure of a sensor shown in FIG. 5.

FIG. 5 shows a modification of the sensor 16, and FIG. 6 is a sectional view of a power source outlet device for explaining a mounting structure of the sensor 16 shown in FIG. 5. The sensor 16 is formed with a metal plate punched in a generally U shape and it is formed integrally so as to correspond to two sensor pieces. The sensor 16 is provided at a rear portion thereof with a terminal 16*a* projecting from a rear face of the intermediate base body 5.

On the other hand, an insertion terminal 27 is provided on a front face of the circuit board 22 at a position corresponding to the terminal 16*a* of the sensor 16, so that it is made possible to conduct electrical connection with the circuit board 22 by only performing inserting work of the terminal 16*a* of the sensor 16 into the insertion terminal 27. Incidentally, same constituent elements as those in FIG. 2 and FIG. 3 are attached with same reference numerals, and explanation thereof is omitted.

By adopting such a terminal structure, the sensor and the circuit board can be connected by only insertion operation, so that connection operation becomes easy.

Incidentally, since the sensor 16 is formed integrally to correspond to two sensor pieces, only one insertion hole 27 can be provided in FIG. 5, but sensors 16 are provided to respective receiving blades 17 one-by-one, the insertion terminals 27 are required by the number corresponding to the number of the sensors 16.

Figure 7:
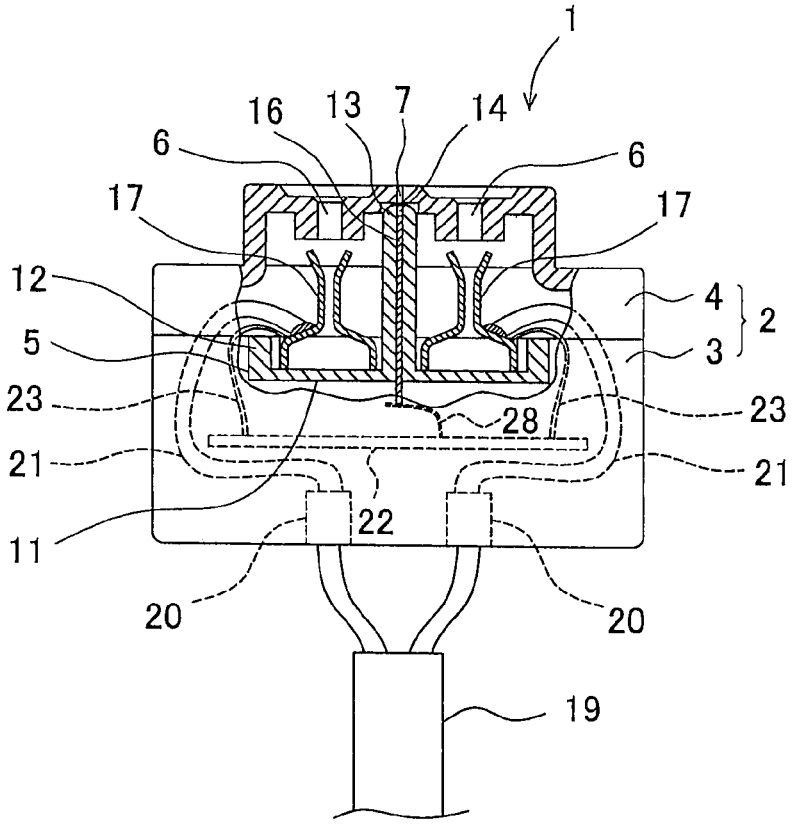
FIG. 7 is a sectional view of a main portion of a power source outlet device showing a modification of a constitution of a sensor mounting portion.

A sectional view of a power source outlet device shown in FIG. 7 shows a modification of the sensor mounting portion. In FIG. 7, the sensor 16 is provided such that its rear end projects from the back face of the intermediate base body 5, and an elastically deformable connection terminal 28 of a leaf spring type is provided at a position of the circuit board 22 opposed to the rear end of the sensor 16. Incidentally, same constituent elements as those in FIG. 2 and FIG. 3 are attached with same reference numerals, and explanation thereof is omitted.

Accordingly, when the power source outlet device 1 is assembled, the rear end of the sensor 16 comes in contact with the connection terminal 28 to be electrically connected to the circuit board 22, so that connection operation between the sensor and the circuit board is easy. Incidentally, such a constitution may be adopted that the rear end of the sensor 16 is formed to be elastically deformable and the rear end is brought in contact with the connection terminal 28 of the circuit board 22 so that the both are connected to each other, or the both are elastically deformed to be connected to each other.

Figure 8:
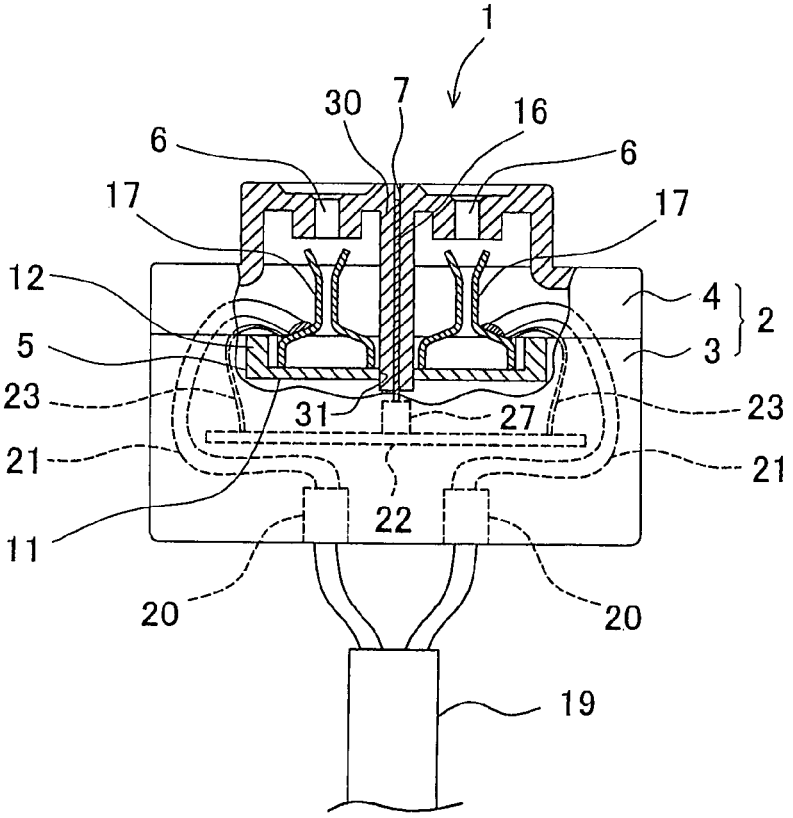
FIG. 8 is a sectional view of a main portion of a power source outlet device showing a modification of a constitution of a sensor mounting portion.

A sectional view of a power source outlet device shown in FIG. 8 shows a modification of the sensor mounting portion. In FIG. 8, a partition wall 30 is integrally formed on a back face of the cover body 4. Further, a through-hole 31 is provided at an intermediate position of the intermediate base plate 5 in its shorter side direction, and the partition wall 30 penetrates the through-hole 31 at an assembling time. Incidentally, same constituent elements as those in FIG. 6 are attached with same reference numerals, and explanation thereof is omitted. Therefore, the hole of the partition wall and through-hole of the cover body are prevented from deviating from each other.

Incidentally, although the embodiment is directed to a two port power source outlet device to which two plugs can be connected, the present invention may be directed to a one port power source outlet device, an extension tap to which a plurality of plugs can be connected, or the like. Further, although the embodiment is constituted to house the breaker therein to break the cable run, the present invention is not limited regarding behavior at a tracking detecting time. Furthermore, it is possible to modify the shape, structure, function, and the like of the power source outlet device such as forming the intermediate base integrally with the main body properly without departing from the spirit and scope of the invention to perform implementation.

Second Embodiment

Figure 9:
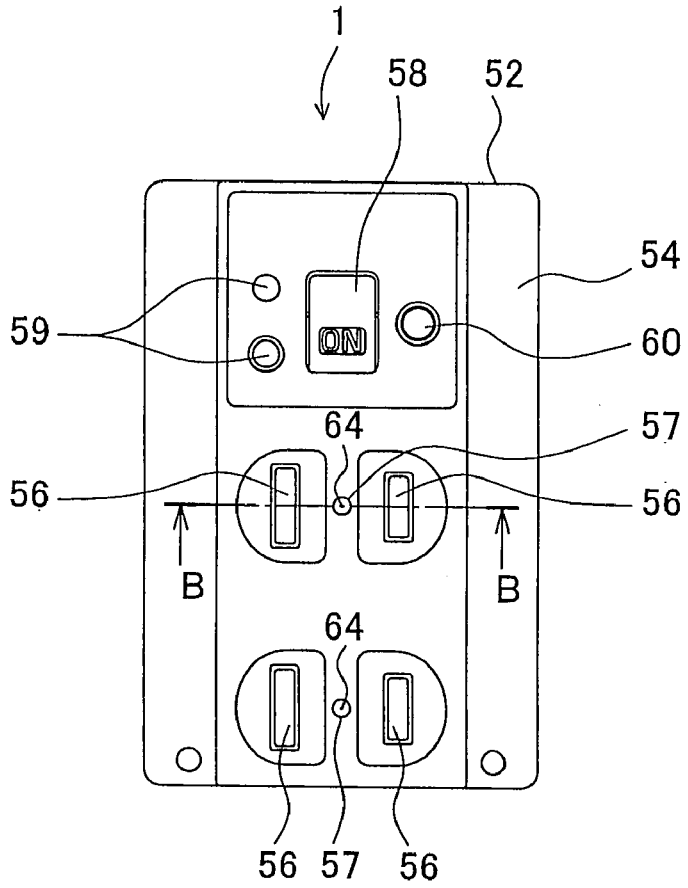
FIG. 9 is a front view of a power source outlet device showing a second embodiment of the present invention.
Figure 10:
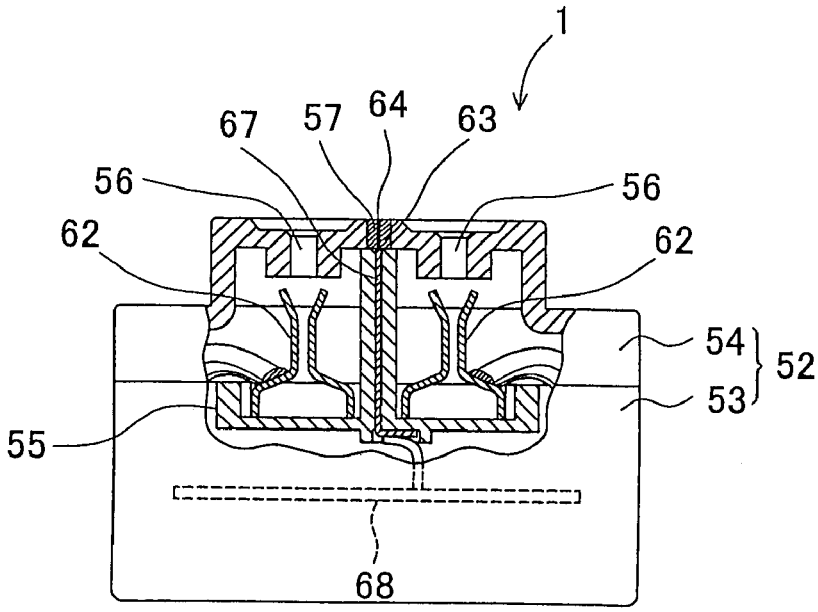
FIG. 10 is a sectional view of the power source outlet device taken along line B—B shown in FIG. 9.

FIG. 9 and FIG. 10 show a second embodiment of a power source outlet device of the invention, FIG. 9 being a front view of the second embodiment and FIG. 10 being a sectional view thereof taken along line B—B shown in FIG. 9. An outlet case 52 of a power source outlet device 1 is constituted of a main body 53 with a front face opened, a cover body 54 mounted so as to close the front face opening of the main body 53, and an intermediate base body 55 accommodated in an inner space formed by the main body 53 and the cover body 54. The outlet case 52 is formed from insulating material such as synthetic resin, and it is assembled internally thereof with a leakage current detecting circuit, a breaker for breaking a cable run and the like.

The cover body 54 is formed on a front face thereof with a pair of plug insertion holes 56, 56 for inserting plug blades (not shown) of a plug at each of two positions of a central portion and a lower portion thereof, and a through-hole 57 is formed at an intermediate position between plug insertion holes of each pair. The cover body 54 is provided on its upper portion with an operation handle 58 for performing return operation of the breaker which has performed breaking behavior at a tracking time, display lamps 59 which display leakage occurrence, tracking occurrence and the like, and a test button 60 which tests leakage breaking behavior.

Figure 11:
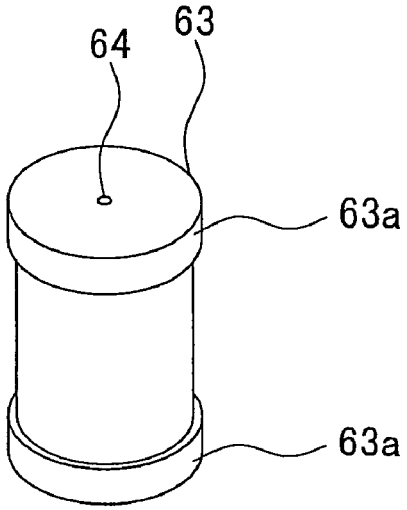
FIG. 11 is a perspective view of a bushing shown in FIG. 9.

A receiving blade 62 pinches a plug blade of a plug inside the plug insertion hole 56, and a bushing 63 shown with a perspective view in FIG. 11 is mounted to the through-hole 57. The bushing 63 is formed from soft resin material or rubber material having elasticity such that its outer shape is slightly larger than the shape of the through-hole 57. Then, the bushing 63 is formed in a cylindrical shape coincident with the through-hole 57, and it has a detection hole 64 formed on a center axis thereof in a penetrating manner. Further, flange portions 63*a* are provided such that upper and lower ends of the bushing comes in close contact with the through-hole 57 reliably.

The bushing 63 is pressure-fitted into the through-hole 57 and mounted thereto such that a surface of the outlet case 52 and a sensor 67 described later are caused to communicate with each other via the detection hole 64.

The sensor 67 is disposed inside the through-hole 57 internally of the outlet case 52. The sensor 67 is formed of an electrically conductive member such as a metal piece, and it is connected to a tracking detecting circuit of a circuit board 68 disposed internally of the outlet case 52.

The power source outlet device 1 with the above constitution performs a tracking detecting behavior in the following manner. When dusts are accumulated between the plug blades of the plug connected to the receiving blades 62, 62 and the dusts absorb air moisture, a minute current flows between the plug blades via the moisture. When moisture thus charged evaporates, a spark discharge occurs. Then, when the spark discharge which has occurred enters from the detection hole 64 of the bushing 63 provided in the through-hole 57 to come in contact with the sensor 67, a minute current flows in the sensor 67. The tracking detecting circuit detects tracking from an output current of the sensor 67 to cause the breaker to behave and break the cable run, and perform displaying by the display lamp 59.

Since the bushing having the detection hole is mounted to the through-hole in this manner, it is unnecessary to downsize the through-hole to the limit, so that moldability of the outlet case can be improved and the productivity is improved. Further, a hole diameter of the detection hole can be made small easily. For example, the hole diameter can be set to about 0.1 mm by utilizing shrinkage of an contour of the bushing due to pressure-fitting mounting. In addition, since the bushing has elasticity, even if the detection hole clogs up due to dusts, the detection hole can be cleaned easily by using a needle with a diameter slightly larger than the hole diameter of the detection hole or the like.

Third Embodiment

Figure 13:
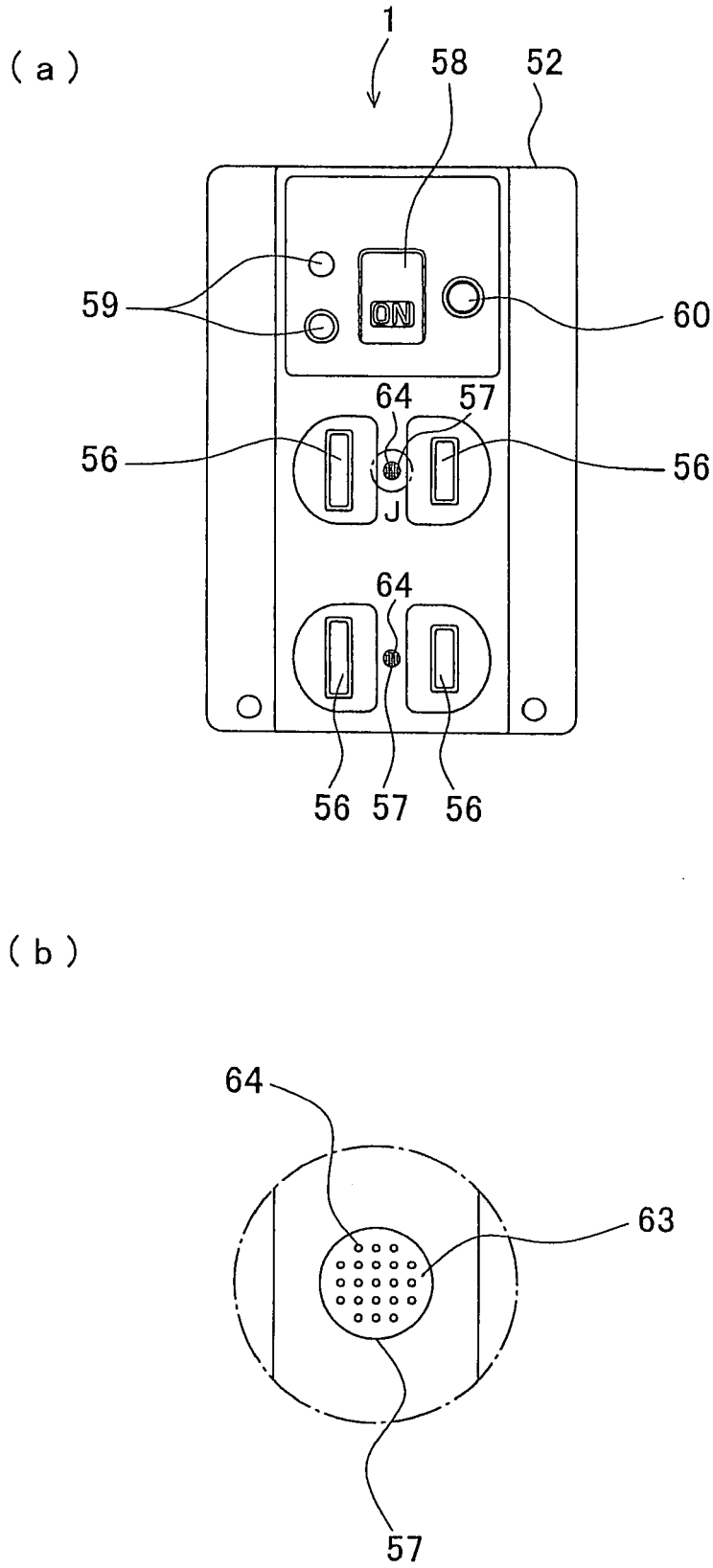
FIG. 13 shows a third embodiment of the present invention, (a) being a front view of a power source outlet device and (b) being an enlarged view of a portion J indicated in (a)

FIG. 13 shows a power source outlet device showing a third embodiment of the invention, in which (a) is a front view of the power source outlet device and (b) is an enlarged view of a portion J indicated in (a). This embodiment is different from the second embodiment shown in FIG. 9 in that a plurality of detection holes 64 are formed in the bushing 63. Incidentally, same constituent elements as those in the second embodiment are attached with same reference numerals, and explanation thereof is omitted.

When many detection holes are formed in the bushing in this manner, a spark discharge can be detected on the surface of an area, so that a detection range can be expanded.

Figure 12:
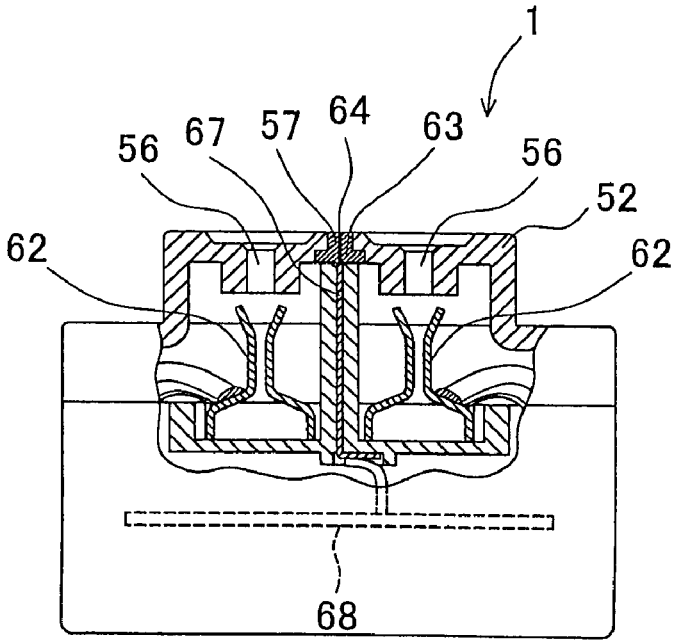
FIG. 12 is a sectional view of a power source outlet device showing modifications of a through-hole and a bushing.

Incidentally, in the second and third embodiments, although the through-hole 57 is formed in a circular shape and the bushing 63 is formed in a cylindrical shape, the through-hole 57 and the bushing 63 may be formed to have one ends diameter-expanded, for example, as shown in FIG. 12. Further, the through-hole 57 and the bushing 63 may be formed in a rectangular shape or they may have a long hole shape. Shapes of the through-hole and the bushing of the outlet case 52 are not limited.

Fourth Embodiment

Figure 14:
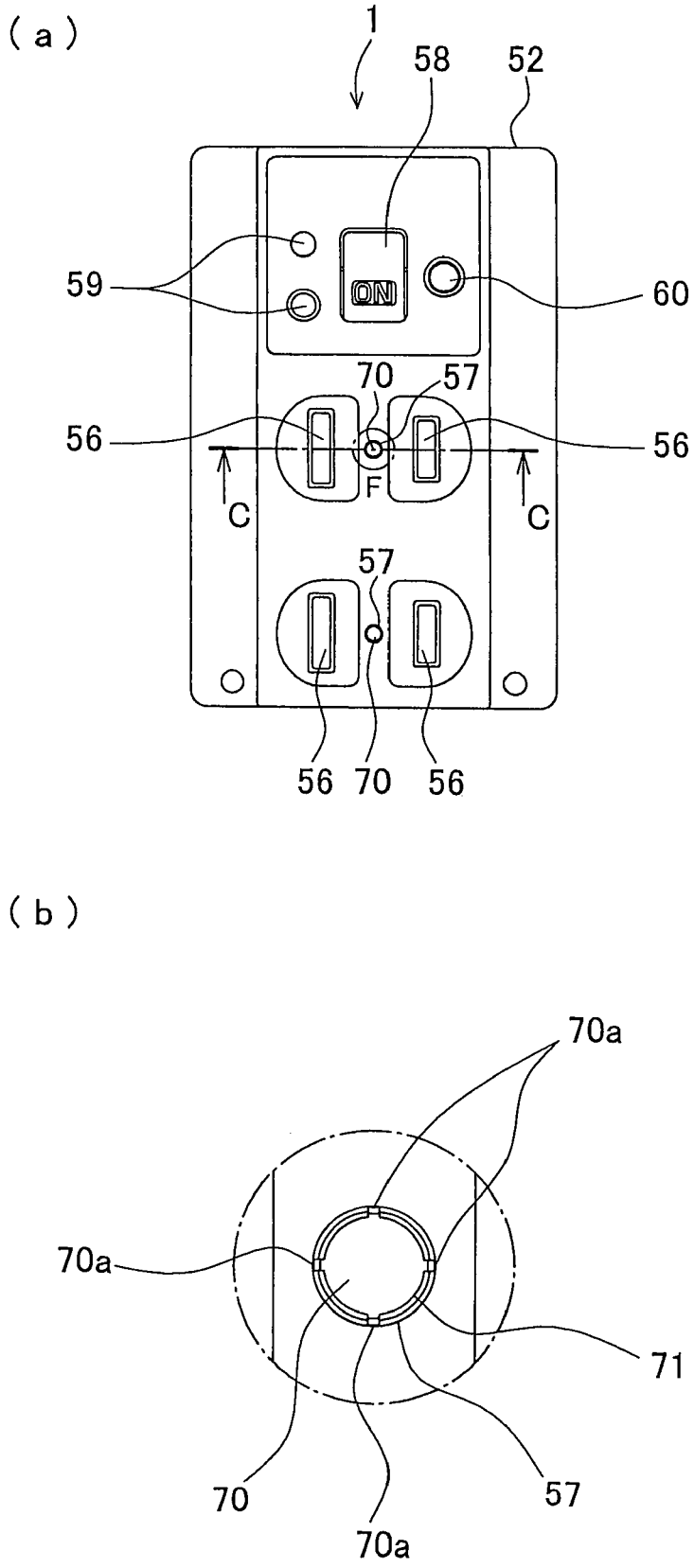
FIG. 14 shows a fourth embodiment of the present invention, (a) being a front view of a power source outlet device and (b) being an enlarged view of a portion F indicated in (a)
Figure 15:
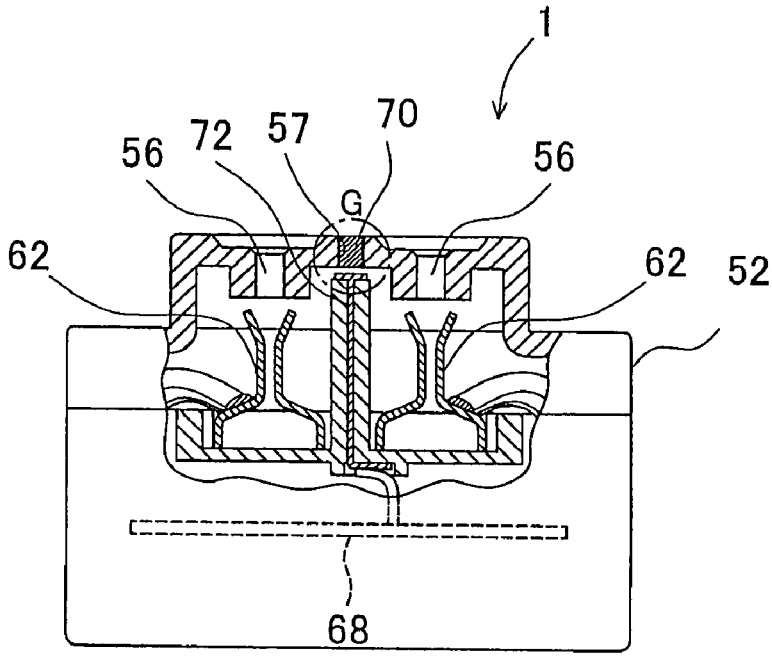
FIG. 15(*a*) is a sectional view of the power source outlet device taken along line C—C shown in FIGS. 14 and 15(*b*) is an enlarged view of a portion G shown in FIG. 15(*a*)
Figure 15:
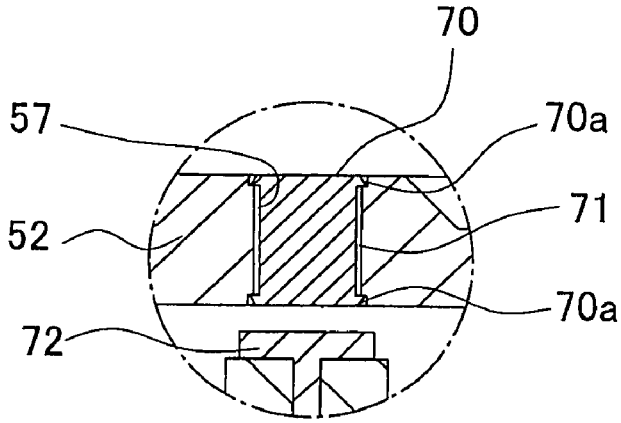
Figure 16:
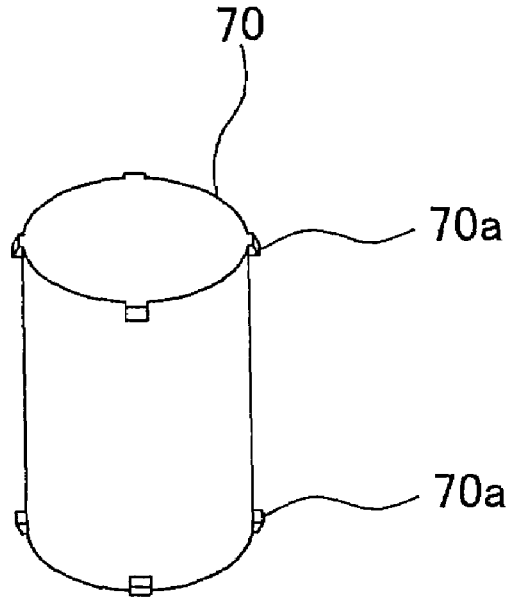
FIG. 16 is a perspective view of a bushing shown in FIG. 14.

FIG. 14 and FIG. 15 show a fourth embodiment of the invention, in which FIG. 14(*a*) is a front view of a power source outlet device, FIG. 14(*b*) is an enlarge view of a portion F indicated in FIG. 14(*a*), FIG. 15(*a*) is a sectional view taken along line C—C shown in FIG. 14(*a*), and FIG. 15(*b*) is an enlarged view of a portion G indicated in FIG. 15(*a*). The embodiment is different from the second embodiment shown in FIG. 9 in constitutions of the through-hole 57 and a bushing 70, and shape of a sensor 72. The bushing 70 is formed from insulating material to have an outer shape slightly smaller than a shape of the through-hole 57. FIG. 16 is a perspective view of the bushing 70, the bushing 70 is formed in a cylindrical shape so as to match with the through-hole 57, and it has engagement projections 70*a* formed around upper and lower end portions thereof. When the bushing 70 is inserted into the through-hole 57, the engagement projections 70*a* are engaged with end edges of the through-hole 57, so that mounting can be achieved. Incidentally, same constituent elements as those in the second embodiment shown in FIGS. 9, 10 are attached with same reference numerals, and explanation thereof is omitted.

By forming the bushing 70 in this manner, a gap 71 causing an outer face of the outlet case 52 and an inner face of the outlet case 52 to communicate with each other can be formed between the through-hole 57 positioned around the bushing 70 and the bushing 70, so that the gap 71 can be utilized as a hole when a sensor 67 described later detects a spark discharge. Incidentally, a distal end of the sensor 72 facing the bushing 70 is formed in a flat shape to match with a shape of the gap 71, so that a spark discharge can be detected on an area.

With this constitution, tracking detection is performed by the power source outlet device 1 in the following manner. A spark discharge causing tracking occurs due to dusts built up between the plug blades of the plug connected to the receiving blades 62, 62 and moisture. Then, when the spark discharge enters from the gap 71 between the through-hole 57 and the bushing 70 to come in contact with the sensor 72, a minute current flows. The tracking detecting circuit detects tracking from an output current from the sensor 72 and causes a breaker housed in the outlet case 52 to behave to break a cable run and perform display by the display lamps 59.

Since it is made unnecessary to reduce a hole diameter of the through-hole by mounting the bushing in the through-hole in this manner, moldability of the outlet case is excellent and productivity is improved. Further, the gap between the through-hole utilized as a hole of a sensor for detection and the bushing can be formed in a small size easily.

Fifth Embodiment

Figure 17:
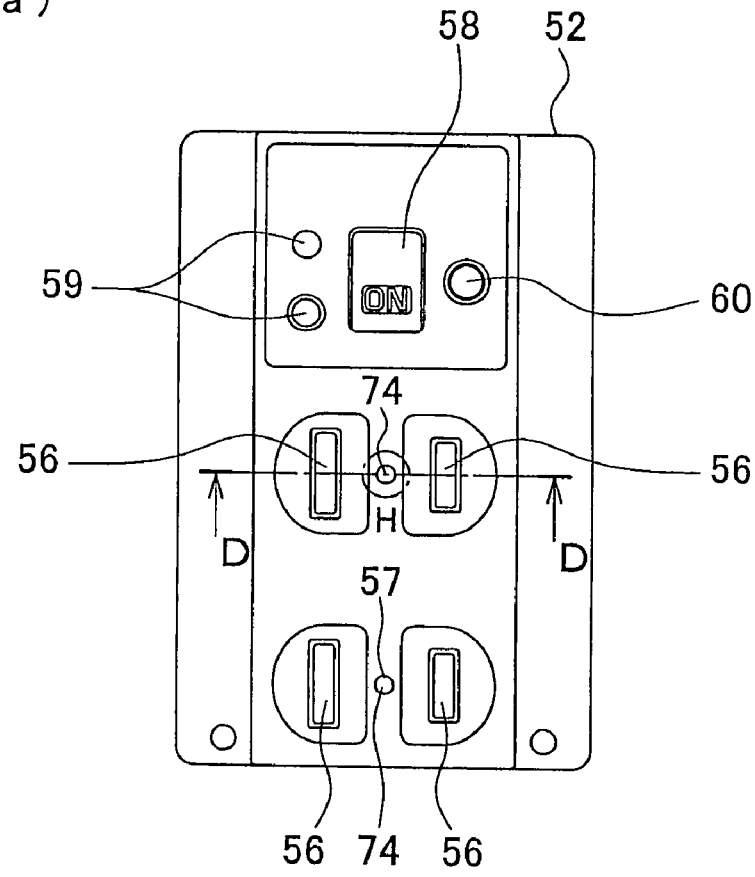
FIG. 17 shows a fifth embodiment of the present invention, (a) being a front view of a power source outlet device and (b) being an enlarged view of a portion H indicated in (a)
Figure 17:
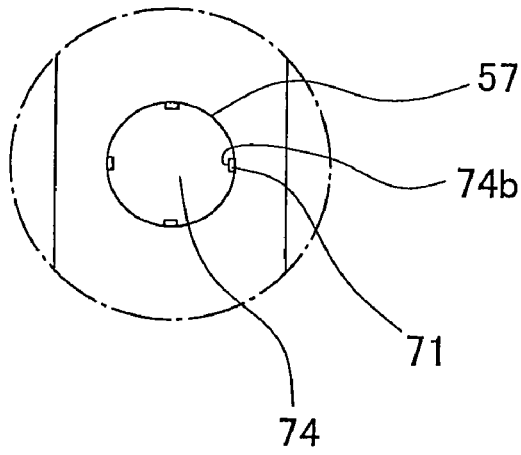
Figure 18:
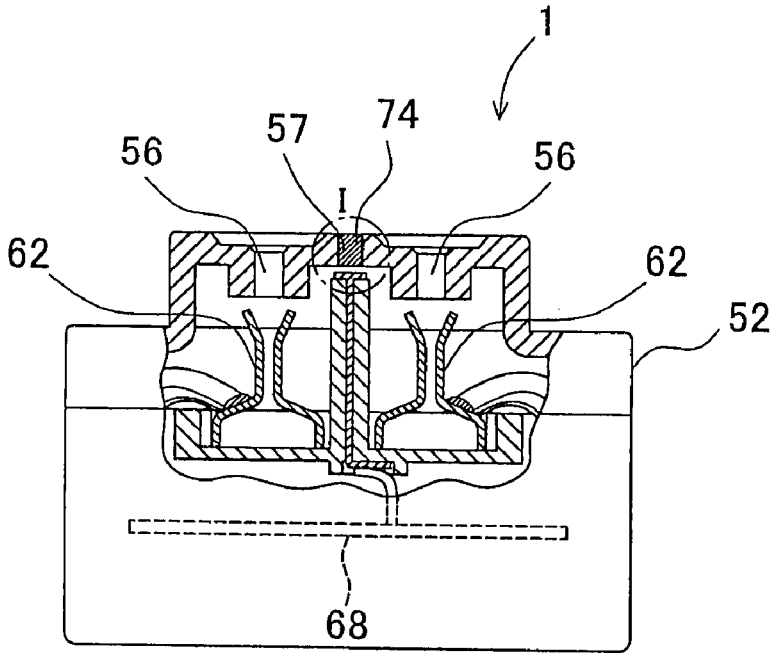
FIG. 18(*a*) is a sectional view of the power source outlet device taken along line D—D shown in FIGS. 17 and 18(*b*) is an enlarged view of a portion I shown in FIG. 18(*a*)
Figure 18:
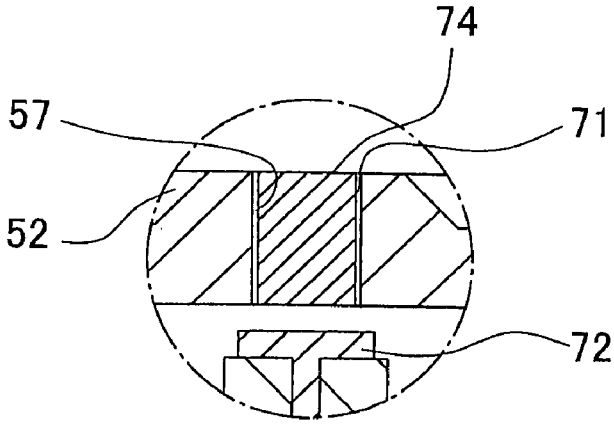

FIG. 17 and FIG. 18 show a fifth embodiment of the invention, in which FIG. 17(*a*) is a front view of a power source outlet device, FIG. 17(*b*) is an enlarged view of a portion F indicated in FIG. 17(*a*), FIG. 18(*a*) is a sectional view taken along line D—D shown in FIG. 17(*a*), and FIG. 18(*b*) is an enlarged view of a portion I indicated in FIG. 18(*a*). The embodiment is mainly different from the fourth embodiment shown in FIG. 14, in shape of a bushing 74. Incidentally, same constituent elements as those in the fourth embodiment shown in FIG. 14 are attached with same reference numerals, and explanation thereof is omitted.

Figure 19:
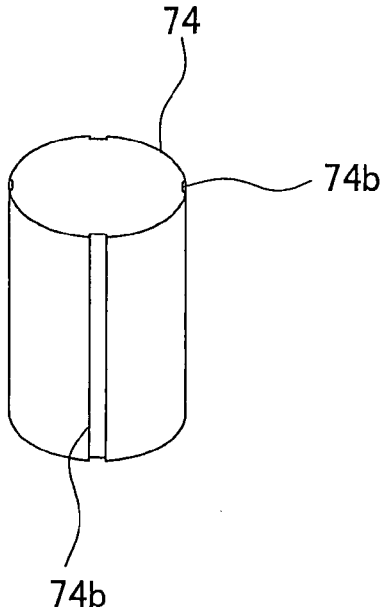
FIG. 19 is a perspective view of a bushing shown in FIG. 17.

The bushing 74 is formed from insulating material, and it has a shape as shown in a perspective view in FIG. 19. The bushing 74 is formed to have substantially the same shape as the through-hole 57, and a plurality of grooves 74*b* extending in an insertion direction are formed on a face of the bushing 74 coming in contact with the through-hole 57.

Gaps 71 are formed on a contact face between the bushing 74 and the through-hole 57 by the grooves 74*b*, and when a spark discharge enters from the gaps 71 to come in contact with the sensor 72, a minute current flows. The tracking detecting circuit detects tracking from an output current from the sensor 72 and causes a breaker housed in the outlet case 52 to behave to break the cable run and perform display by the display lamps 59.

Since it is made unnecessary to reduce the hole diameter of the through-hole by mounting the bushing in the through-hole in this manner, moldability of the outlet case is excellent and productivity is improved. Further, the gap between the through-hole utilized as a hole of a sensor for detection and the bushing can be formed in a small size easily.

Incidentally, the groove 74*b* may be formed on a face of the through-hole 57 coming in contact with the bushing 74 instead of the bushing 74. Further, the number of grooves 74*b* may be one. However, when a plurality of grooves 74*b* are formed, a detection range of the sensor 72 can be expanded.

Furthermore, in the fourth and fifth embodiments, though the through-hole 57 has been formed in a circular shape, it may be formed in a rectangular shape or it may be formed in an elongated hole shape, for example. If a gap between of the through-hole 57 and the bushing 74 is formed, shapes of the through-hole 57 and the bushing 74 are not limited to specific ones. Further, regarding the mounting structure of the bushing 74, adhesion mounting may be adopted or pressure-fitting mounting may be adopted.

Sixth Embodiment

Figure 20:
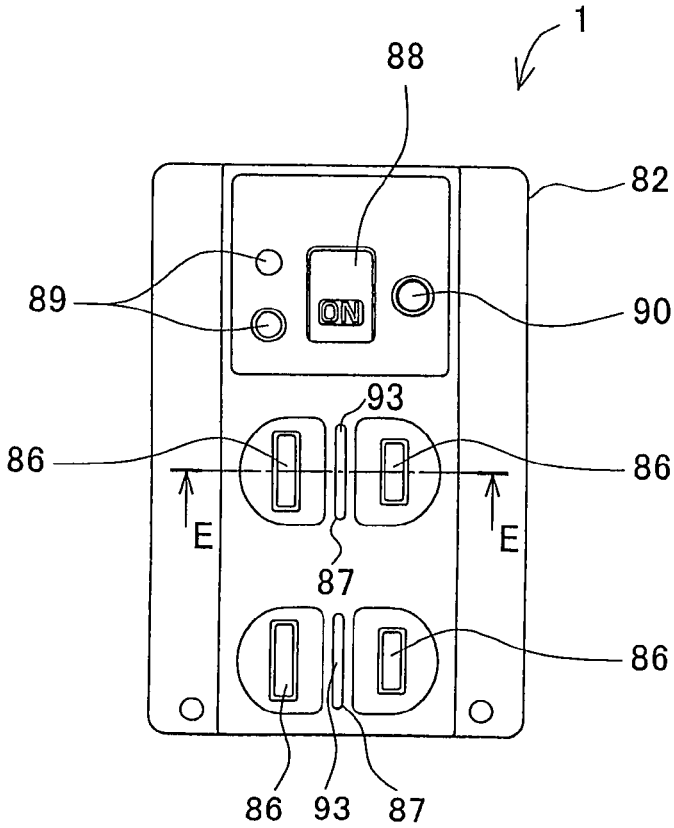
FIG. 20 is a front view of a power source outlet device showing a sixth embodiment of the present invention.
Figure 21:
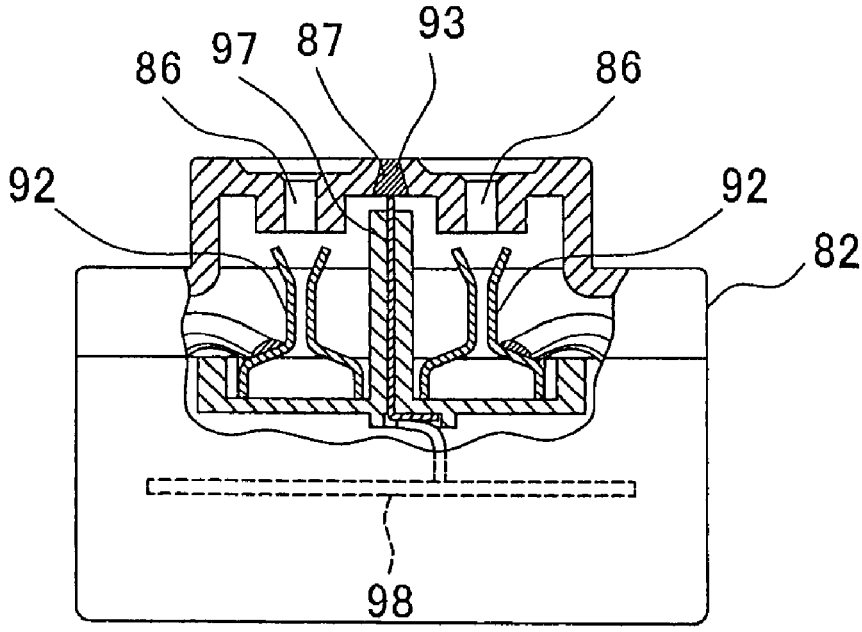
FIG. 21 is a sectional view of the power source outlet device taken along line E—E shown in FIG. 20.

FIG. 20 and FIG. 21 show a sixth embodiment of the invention, FIG. 20 being a front view of a power source outlet device and FIG. 21 is a sectional view of the power source outlet device taken along line E—E in FIG. 20. An outlet case 82 of a power source outlet device 1 is constituted of a main body 83 with a front face opened, a cover body 84 mounted so as to close the front face opening of the main body 83, and an intermediate base body 85 accommodated in an inner space formed by the main body 83 and the cover body 84. The outlet case 82 is formed from insulating material such as synthetic resin, and it is assembled internally thereof with a leakage current detecting circuit, a breaker for breaking a cable run and the like.

The cover body 84 is formed on a front face thereof with a pair of plug insertion holes 86, 86 for inserting plug blades (not shown) of a plug at each of two positions of a central portion and a lower portion, and a through-hole 87 is formed at an intermediate position between the plug insertion holes of each pair. The cover body 84 is provided on its upper portion with an operation handle 88 for performing return operation of the breaker which has performed breaking behavior at a tracking time, display lamps 89 which display leakage occurrence, tracking occurrence and the like, and a test button 90 which tests leakage breaking behavior.

A receiving blade 92 pinching a plug blade of a plug is disposed internally of the plug insertion hole 86, and the through-hole 87 is formed to extend long in parallel to a longitudinal direction of the receiving blade 92. Then, an insulating permeable body 93 shown with a perspective view in FIG. 11 is attached to the through-hole 87. The permeable body 93 is formed such that its outer shape is slightly larger than a shape of the through-hole 87 and it matches with the through-hole 87. For example, wood, sponge, fiber or the like can be used as the permeable body. The permeable body 93 is pressure-fitted into the through-hole and mounted thereto.

A sensor 97 is disposed on a back face of the permeable body 93 which is the inside of the through-hole 87 internally of the outlet case 82. The sensor 97 is formed of an electrically conductive member such as a metal piece, and it is connected to a tracking detecting circuit of a circuit board 98 disposed internally of the outlet case 82.

With the constitution, tracking detection is performed by the power source outlet device 1 in the following manner. When a spark discharge causing tracking occurs between the plug blades of the plug connected to the receiving blades 92, 92 due to dusts and moisture, the spark discharge comes in contact with the permeable body 93. At this time, since the permeable body 93 also becomes moist to have electrical conductivity, a current flows to the sensor 97 via the permeable body 93. The tracking detecting circuit detects tracking from an output current from the sensor 92 and causes a breaker housed in the outlet case 82 to behave to break a cable run and perform display by the display lamps 89.

Since the permeable body is mounted in the through-hole in this manner, it is unnecessary to downsize the hole diameter of the through-hole, so that moldability of the outlet case is excellent and productivity is improved. Further, a spark discharge can be detected over the whole through-hole, a detection range of a spark discharge can be expanded, cleaning can be performed by only wiping a surface of the permeable body and cleaning can be performed easily.

Incidentally, in the above sixth embodiment, though the through-hole has been formed in a vertically long elongated hole shape, it may be formed in a circular or rectangular shape, for example. Further, in the above embodiment, a wall face outlet structure provided on a wall face has been shown, but a shape of a table tap to which a plurality of plugs can be connected or the like can be adopted. Furthermore, such a constitution has been adopted that a breaker is built in to break a cable run, but behavior at a tracking detecting time is not limited.

REFERENCE NUMERALS

2 . . . outlet case, 3 . . . main body, 4 . . . cover body, 5 . . . intermediate base body, 6 . . . plug insertion hole, 7 . . . through-hole, 13 . . . partition wall, 14 . . . hole, 15 . . . sensor insertion hole, 16 . . . sensor, 17 . . . receiving blade, 30 . . . partition wall, 52 . . . outlet case, 56 . . . plug insertion hole, 57 . . . through-hole, 62 . . . receiving blade, 63 . . . bushing, 64 . . . detection hole, 67 . . . sensor, 70 . . . bushing, 71 . . . gap, 72 . . . sensor, 74 . . . bushing,

82 . . . outlet case, 86 . . . plug insertion hole, 87 . . . through-hole, 92 . . . receiving blade, 93 . . . permeable body, and 97 . . . sensor.

The invention claimed is:

1. A power source outlet device which is provided on a front face of an outlet case formed from insulating material with at least one pair of plug insertion holes, and receiving blades paired which pinch plug blades of a plug being disposed inside the plug insertion holes, and the power source outlet device having a through-hole between the plug insertion holes on the front face of the outlet case, and a sensor which detects a spark discharge occurring between the plug blades being disposed internally of the through-hole, characterized in that a partition wall made from insulator is disposed between the receiving blades in a standing manner, the sensor is received in the partition wall, and the sensor is disposed such that a portion thereof faces the through-hole.

2. A power source outlet device according to claim 1, characterized in that the outlet case comprises an intermediate base body which has a receiving blade mounting portion and the partition wall and which holds the sensor, a main body which holds a circuit board and the intermediate base body, and a cover body which covers a front face of the main body and has the plug insertion holes.

3. A power source outlet device according to claim 1, characterized in that the sensor is received in the partition wall by insertion molding.

4. A power source outlet device according to claim 2, characterized in that the sensor is received in the partition wall by insertion molding.

5. A power source outlet device according to claim 1, characterized in that a sensor insertion hole is formed in the partition wall and the sensor is fittingly inserted in the sensor insertion hole to be received therein.

6. A power source outlet device according to claim 2, characterized in that a sensor insertion hole is formed in the partition wall and the sensor is fittingly inserted in the sensor insertion hole to be received therein.

7. A power source outlet device according to claim 2, characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board.

8. A power source outlet device according to claim 3, characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board.

9. A power source outlet device according to claim 4, characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board.

10. A power source outlet device according to claim 5, characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board.

11. A power source outlet device according to claim 6, characterized in that the sensor is made of a metal plate and the circuit board is disposed behind the partition wall, a rear end of the sensor is extended so as to reach the circuit board, and electrical connection is achieved by inserting the rear end into an insertion hole provided in the circuit board.

12. A power source outlet device according to claim 2, characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other.

13. A power source outlet device according to claim 3, characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other.

14. A power source outlet device according to claim 4, characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other.

15. A power source outlet device according to claim 5, characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other.

16. A power source outlet device according to claim 6, characterized in that the sensor is made of a metal plate and the circuit board is disposed behind the partition wall, a rear end of the sensor is extended so as to reach the circuit board, at least one of the rear end of the sensor and a sensor connection portion of the circuit board is formed to be elastically deformable, and both of the rear end of the sensor and the sensor connection portion are brought in contact with each other to be electrically connected to each other.

17. A power source outlet device which is provided on a front face of an outlet case formed from insulating material with at least one pair of plug insertion holes, and receiving blades paired which pinch plug blades of a plug being disposed inside the plug insertion holes, and the power source outlet device having a through-hole between the plug insertion holes on the front face of the outlet case, and a sensor which detects a spark discharge occurring between the plug blades being disposed internally of the through-hole, characterized in that a bushing with elasticity made from insulating material is pressure-fitted into the through-hole and the bushing has at least one through-hole extending in a pressure-fitting direction, and a surface of the outlet case and the sensor are caused to communicate with each other through the through-hole so that the sensor can detect a spark discharge.

18. A power source outlet device which is provided on a front face of an outlet case formed from insulating material with at least one pair of plug insertion holes, and receiving blades paired which pinch plug blades of a plug being disposed inside the plug insertion holes, and the power source outlet device having a through-hole between the plug insertion holes on the front face of the outlet case, and a sensor which detects a spark discharge occurring between the plug blades being disposed internally of the through-hole, characterized in that a bushing with elasticity made from insulator is pressure-fitted into the through-hole and a gap is provided at at least one portion of a contacting face between the bushing and the through-hole, a surface of the outlet case and the sensor are caused to communicate with each other through the gap so that the sensor can detect a spark discharge.

19. A power source outlet device which is provided on a front face of an outlet case formed from insulating material with at least one pair of plug insertion holes, and receiving blades paired which pinch plug blades of a plug inside the plug insertion holes being disposed, and the power source outlet device having a through-hole between the plug insertion holes on the front face of the outlet case, and a sensor which detects a spark discharge occurring between the plug blades being disposed internally of the through-hole, characterized in that a bushing made of an insulating water permeable body is embedded in the through-hole.

* * * * *